United States Patent [19]

Chapron et al.

[11] 4,078,199

[45] Mar. 7, 1978

[54] DEVICE FOR SUPPLYING A REGULATED CURRENT

[75] Inventors: Claude Chapron, Caen; Jean-Claude Kaire, St-Germain-la-Blanche Herbe, both of France

[73] Assignee: U.S. Philips Corporation, New York, N.Y.

[21] Appl. No.: 678,867

[22] Filed: Apr. 21, 1976

[30] Foreign Application Priority Data

Apr. 24, 1975 France ..... 75 12809
Mar. 26, 1976 France ..... 76 08862

[51] Int. Cl.[2] ..... G05F 1/60

[52] U.S. Cl. ..... 323/1; 307/303; 323/4; 323/8

[58] Field of Search ..... 323/1, 4, 9, 8; 307/296, 297, 299 B, 303, 213; 330/30 D; 357/44

[56] References Cited

U.S. PATENT DOCUMENTS

| | | | |
|---|---|---|---|
| 3,648,153 | 3/1972 | Graf | 323/1 |
| 3,681,623 | 8/1972 | Hoffman et al. | 323/4 |
| 3,911,353 | 10/1975 | van de Plassche | 323/4 |
| 3,925,718 | 12/1975 | Wittlinger | 323/4 |
| 3,947,704 | 3/1976 | Blauschild | 307/297 |
| 4,007,385 | 2/1977 | Chapron | 307/303 |
| 4,009,397 | 2/1977 | Mulder et al. | 307/303 |

FOREIGN PATENT DOCUMENTS

| | | | |
|---|---|---|---|
| 2,157,756 | 6/1972 | Germany | 323/4 |

OTHER PUBLICATIONS

*IBM Tech. Disc. Bull.*, vol. 15, No. 5, Oct. 1972, pp. 1590–1591.

*Primary Examiner*—Gerald Goldberg
*Attorney, Agent, or Firm*—Frank R. Trifari; Bernard Franzblau

[57] ABSTRACT

A device for supplying a regulated current to an integrated circuit with current injectors. This device comprises two current paths, the currents which flow in the current paths having a fixed ratio which is maintained by means of a current dividing circuit and upon which current a current dependent ratio is imposed by means of a coupling circuit, in order to stabilize two currents. In accordance with the invention at least one of the semiconductor junctions included in the device, which also stabilize the currents, is constituted by the circuit to be powered, which is based on the recognition that the circuit to be powered exhibits a voltage-current characteristic which corresponds to that of a forward-biased semiconductor junction.

13 Claims, 3 Drawing Figures

DEVICE FOR SUPPLYING A REGULATED CURRENT

Figure 1:
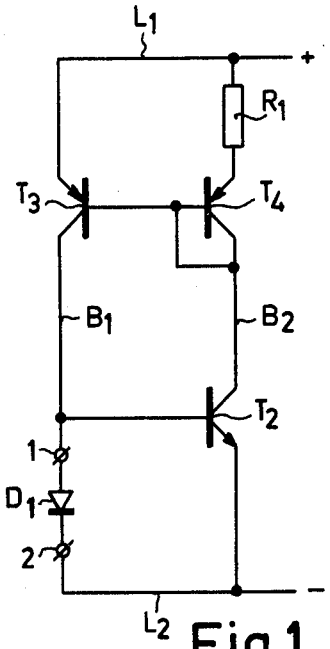

The invention relates to a device for supplying a regulated supply current to an integrated circuit to be powered, which integrated circuit comprises current injectors and at least two supply terminals for the application of the supply current. The device comprises two current paths which are included between two common terminals, a first current dividing circuit which defines a substantially fixed ratio between the currents in the two current paths, and a coupling circuit which provides current-dependent coupling between the two current paths so as to stabilize the currents in the two paths at a specific value.

Integrated logic circuits are known of the type described in U.S. patent application Ser. No. 504,911 filed on Sept. 11, 1974 and now U.S. Pat. No. 4,007,385, which comprise at least one current injector and which are connected in series in respect of the power supply. These injection circuits necessitate the use of supply sources with a constant current, but they can be powered from sources which supply a variable voltage. For example, to supply power to circuits of the $I^2L$ type (injected integrated logic) it is necessary to use a source which supplies a regulated current. However, integrable sources which supply a constant current have a comparatively high power consumption, while their current stabilization means produce an appreciable voltage drop relative to the currents and voltages appearing in the injection circuits. Several types of devices supplying a regulated current are known, such as those described in French Pat. No. 2,117,914. These current sources comprise: two current paths which are included between two common terminals, a first current dividing circuit which defines a fixed ratio between the currents at the terminals of said current dividing circuit, and a coupling circuit which provides a current-dependent coupling between the two current paths, which coupling circuit comprises an impedance in one of the two current paths whose value determines an output current which is independent of the input voltage. In this respect the term "current dividing circuit" is to be understood to mean a circuit in which the parallel connection of semiconductor junctions of diodes and/or transistors results in a specific ratio between the currents at the input and the output of such a circuit. Such a current dividing circuit is for example constituted by two transistors having the same structure, one transistor being used as a diode by interconnecting its base and collector. The emitters of said transistors are connected to a common terminal, their bases being interconnected. If the collector current of the first transistor is designated $I_1$, the current supplied by the transistor which is connected as a diode is $I_2$, and the current available at the common terminal is $I_0$, then $I_0 + I_1 + I_2 = 0$ and $I_2 = KI_1$, where $K$ is a factor which depends on the ratio of the effective emitter areas of the two transistors and on the grain of the first transistor.

In accordance with said patent specification said coupling circuit is constituted by a semiconductor junction in series with the said impedance which shunts the base-emitter junction of a transistor. The current-dependent coupling then ensures that the voltage across the impedance equals the difference between the voltage across said base-emitter junction and said semiconductor junction.

A principal object of the invention is to mitigate the drawbacks associated with the known devices and to provide a device for supplying a constant current, which is independent of the source voltage, the device in accordance with the invention having a minimum voltage drop and being adapted to energize one or more stages of $I^2L$ circuits in series from a source whose voltage varies substantially, the overall dissipation also being minimal.

In accordance with the invention the device for supplying a regulated current is characterized in that the circuit to be powered, viewed between its supply terminals, is included in the device as at least one semiconductor junction which also determines the stabilizing point.

The invention is based on the recognition that an $I^2L$ circuit, viewed between its supply terminals, may be regarded as at least one semiconductor junction with a comparatively large area, and that a minimum dissipation is obtained by replacing one of the semiconductor junctions, preferably that one with the largest area, by the circuit to be powered. If, in a known current stabilizer, the $I^2L$ circuit were powered in series with said known current stabilizer, then the current stabilizer would include at least one semiconductor junction with a dissipation substantially equal to the dissipation of the circuit to be powered. However, the method in accordance with the invention reduces the overall dissipation by at least an amount equal to the dissipation of the circuit to be powered, which circuit now takes the place of said one semiconductor junction of the current stabilizer. Moreover, the area may be reduced by the area required for a diode with such a dissipation and the minimum voltage drop is reduced by an amount equal to at least one diode voltage.

A preferred embodiment of a device in accordance with the invention is characterized in that the coupling circuit comprises a second current dividing circuit which couples the two current paths, that the two current dividing circuits have an input terminal and an output terminal, the input terminal of the second current dividing circuit is connected to the output terminal of the first current dividing circuit via an impedance, and the input terminal of the first current dividing circuit is connected to the output terminal of the second current dividing circuit, the two current dividing circuits providing a coupling between the two current paths such that the loop gain from the input terminal of the first current dividing circuit to the output terminal of the second current dividing circuit is greater than unity, i.e., the open loop current gain between said input and output terminals via the first and second current dividing circuits with the circuit to be powered disconnected, while the circuit to be powered shunts said impedance and the input circuit of the second current dividing circuit, and when energized causes a voltage drop which is greater than the voltage drop across the input circuit of the second current dividing circuit upon energization.

The two current dividing circuits and the series connected impedance together form a feedback loop. The current in this loop tends to increase if the overall gain of the loop is greater than unity. The situation is balanced when the voltage at the terminals of the circuit formed by the impedance and the semiconductor junction reaches the value of the voltage drop across the circuit to be powered in the energized condition, the currents in the loop and in the circuit to be powered then being dependent on the resistance value of the impedance. The current in the circuit to be powered reduces the loop gain to value which is smaller than unity so that the current in the loop cannot increase and the operation of the device is stabilized. As, during operation, the loop gain is smaller than unity, possible spurious signals are attenuated and oscillations are eliminated. As the stabilizing element is constituted by the circuit to be powered, the current consumption of this circuit does not represent a loss of power, the voltage drop across the stabilizing element is an active voltage drop, and the current in the stabilizing element is a useful current.

Each of the two current dividing circuits which define currents with a fixed ratio is preferably constituted by two transistors of the same conductivity type, the same structure, the same shape and the same materials, the collector and base of the one of the two transistors being interconnected. The emitters of the two transistors are interconnected, and so are their bases. When the operating parameters of the two transistors are also identical, the ratio of the collector currents depends on the ratio of the active emitter areas.

Although the device has a stable state and provides constant currents which are determined by the resistance value of the impedance and the internal resistance of the circuit to be powered, said device may also exhibit another stable state in which the currents are zero in the non-conductive state of the transistors of the current dividing circuits. In this case it may be necessary to activate the device by introducing a very small ignition current into the feedback loop by a means whose current consumption should be very small and which cannot affect the gain in the feedback loop.

A suitable ignition means is a transistor whose emitter is connected to a common terminal, whose base is disconnected and whose collector current is introduced into the feedback loop.

Another suitable ignition means is a capacitance which is connected to said common terminal and which is charged when the source is energized. The discharge current is introduced into the feedback loop, preferably after being amplified by a transistor so as to minimize the integrable capacitance. It is to be noted that in all cases where an ignition current is introduced, the ignition means should not affect the regulated current or the gain of the feedback loop during normal operation after ignition.

The circuit to which the regulated current is applied should produce a voltage drop which is greater than the voltage drop across a forward-biased semiconductor junction. This is because the voltage at the terminals of the impedance equals the difference between the voltage difference between the terminals of said circuit and the voltage drop across the emitter-base junction of the transistor which is used as a diode in the current path which includes the impedance.

A preferred embodiment of a device in accordance with the invention is particularly suitable for regulating the current for a circuit which comprises two diode stages, the voltage at the terminals of the impedance then being equal to the voltage drop across a diode.

The two diode stages for example correspond to two logic levels of $I^2L$ circuits. If the circuit which is powered by the regulated current comprises only one stage, which corresponds to a voltage drop across one diode, or at least to an insufficient voltage difference, at least one additional diode is included in series with said circuit so as to obtain a sufficient overall voltage difference.

Preferably, the transistors of the first current dividing circuit are of the pnp conductivity type, whereas the transistors of the second dividing circuit are of the npn conductivity type. The power supply device may take the form of an integrated circuit, including the circuit to be powered which serves as a stabilizing element.

For powering $I^2L$ circuits it is advantageous for the pnp transistors of the first current dividing circuit to have a lateral structure, whereas the npn transistors of the second current dividing circuit have a vertical structure.

In a modification of the device in accordance with the invention the transistors of a current dividing circuit have a common base and a common emitter and said transistors are replaced by one transistor with two collectors. The active emitter areas which determine the ratio of the collector currents are then reduced to the emitter areas disposed opposite each of the collectors.

The invention may be used for supplying a constant current to logic circuits with a specific voltage drop from source supplying variable voltages, in particular in the case where these circuits have a very low power consumption.

The invention is particularly adapted to supply circuits of the $I^2L$ type, specifically $I^2L$ circuits which have two supply voltage levels in series.

Figure 2:
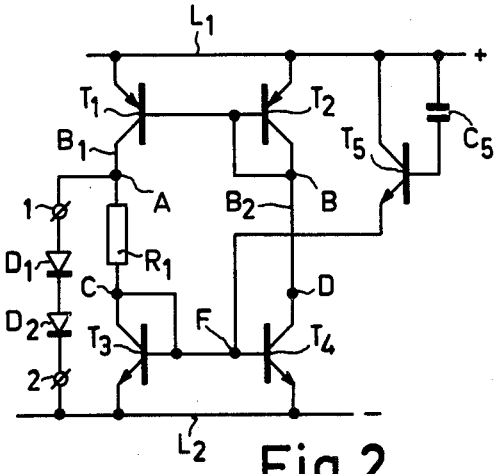
Figure 3:
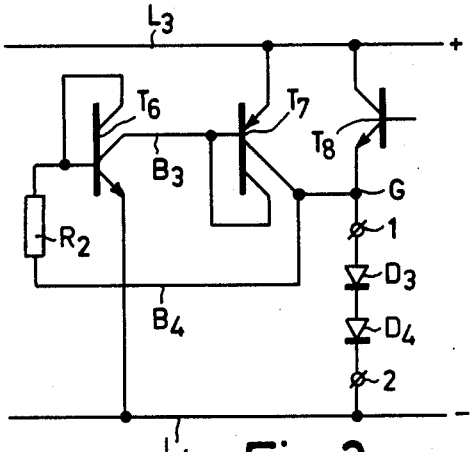

The invention will be described in more detail with references to the drawing in which:

FIG. 1 is a diagram of a device for supplying a regulated current in accordance with the invention, FIG. 2 is a diagram of a preferred embodiment of a device in accordance with the invention, and FIG. 3 is a diagram of a modification of the device in accordance with FIG. 2.

The device shown in FIG. 1 comprises a first current dividing circuit which is constituted by a forward biased diode $D_1$ which is included in a first current path $B_1$ and which shunts the base-emitter junction of an npn transistor $T_2$. The emitter of transistor $T_2$ is connected to the negative supply line $L_2$ and its collector-emitter path is included in a second current path $B_2$. The collector of transistor $T_2$ is connected to a positive supply line $L_1$ via the collector-emitter path of a pnp transistor $T_4$ whose emitter circuit includes a resistor $R_1$. The transistor $T_4$ has its collector and base interconnected so that it operates as a diode. The base of transistor $T_4$ is connected to the base of a pnp transistor $T_3$, whose emitter is connected to the positive supply line $L_1$ and whose collector is connected to the base of transistor $T_2$.

An $I^2L$ type circuit to be powered may be represented by a diode. In FIG. 1 the circuit to be powered is represented by the diode $D_1$. When it is assumed that the transistors $T_3$ and $T_4$ are identical, that the diode $D_1$ has an effective area which is $n$ times as large as the effective base-emitter area of the transistor $T_2$, that the current in the current path $B_1$ is $I_1$, and that the current in the current path $B_2$ is $I_2$, it follows that $I_1 = nI_2$ owing to the current dividing circuit $D_1$, $T_2$. The coupling circuit $T_3$, $T_4$, $R_1$ then realizes the requirement $I_2R = (kt/q)\ ln\ n$, in which $k$ is Bolzmann's constant, $T$ the absolute temperature, $q$ the elementary charge, and $ln$ the symbol for the natural logarithm. For the currents $I_1$ and $I_2$ this yields:

$$I_2 = (kT/qR)\ ln\ n$$

and $$I_1 = n(kT/qR) \ln n.$$

The current $I_1$ is the current which flows through the circuit $D_1$ to be powered. The dissipation of the diode $D_1$ is then a useful dissipation. The voltage drop across the device is minimal when transistor $T_3$ is substantially bottomed ($V_{ce} \approx 0$ V) and then substantially equals one diode voltage ($\approx 0.7$ V).

If such a device were included in series with the circuit to be powered, an additional diode with an effective area which is $n$ times as large as the effective base-emitter area of transistor $T_2$ would be required. This diode would have substantially the same dissipation as the circuit to be powered and would double the minimum voltage drop.

The device shown in FIG. 2 comprises a first current dividing circuit which is constituted by two transistors $T_1$ and $T_2$ whose base-emitter junctions are connected in parallel. The transistor $T_2$ is used as a diode, its base and collector being interconnected. The emitters of the transistors $T_1$ and $T_2$ are connected to a common terminal which is represented by a conductor $L_1$ which has a positive potential +V. The two pnp type transistors $T_1$ and $T_2$ determine the currents in the two current paths $B_1$ and $B_2$ of the device, which currents have substantially the same ratio as the emitter areas of said transistors $T_1$ and $T_2$, save for the gain of the transistor $T_1$.

A second current dividing circuit is constituted by two transistors $T_3$ and $T_4$ whose base-emitter junctions are connected in parallel. The transistor $T_3$ is connected as a diode, the collector being connected to its base. The emitter of the transistors $T_3$ and $T_4$ are connected to a common terminal which is represented by a conductor $L_2$ which has a negative potential −V. The npn type transistors $T_3$ and $T_4$ transfer currents to the common terminal $L_2$ whose values are in substantially the same ratio as the emitter areas of the transistors $T_3$ and $T_4$, save for the gain of the transistor $T_4$. The current dividing circuits are sometimes referred to as current mirrors.

The current path $B_1$ includes a resistor $R_1$ in series with the transistors $T_1$ and $T_3$.

In FIG. 2 the circuit to be powered is represented by two forward-biased diodes $D_1$ and $D_2$ which are connected in series and whose maximum overall voltage drop is greater than that across the transistor $T_3$ which is connected as a diode. The series connection of the diodes $D_1$ and $D_2$ is included between the terminal A of the resistor $R_1$ nearest the first current dividing circuit and the second common terminal which is represented by the conductor $L_2$.

A transistor $T_5$ whose base is controlled by a capacitor $C_5$ is included between the common terminal $L_1$ and the connection point of the bases of the transistors $T_3$ and $T_4$. This capacitor and the transistor $T_5$, which amplifies the capacitor charge and discharge currents, together constitute an ignition means which sometimes may be required.

When the device is considered as starting from a voltage which is initially zero and which increases rapidly, the charging current of the capacitor $C_5$ which is amplified by the transistor $T_5$ is injected into point F of the feedback loop, and said charging current drives the base of the transistor $T_4$. Transistor $T_4$ then becomes conductive so that the base of transistor $T_1$ is energized and transistor $T_1$ is also turned on. The current which flows in the loop constituted by the transistors $T_1$, $T_2$, $T_3$, $T_4$ and the resistor $R_1$ can increase, the loop gain being greater than unity and the voltage at the terminals of the diodes $D_1$ and $D_2$ being insufficient to allow a significant current to flow in the circuit formed by them.

When the voltage at point A suffices to assure that the diodes $D_1$ and $D_2$ are turned on, a part of the current supplied by the transistor $T_1$ passes through the diodes $D_1$ and $D_2$, and the gain of the feedback loop is reduced to a value smaller than unity. The current in this loop can no longer increase and is stabilized at the value which is reached. This value is determined by the resistance value of the resistor $R_1$. The current in this resistor equals:

$$I_1 = \frac{V_{D1} + V_{D2} - V_{BET3}}{R_1},$$

where $V_{D1}$ and $V_{D2}$ are the voltages at the terminals of the diodes $D_1$ and $D_2$, and $V_{BET3}$ is the base-emitter voltage of the transistor $T_3$. Thus, the current in the current path $B_2$ is defined and equals $I_2 = KI_1$, in which $K$ is the ratio of the emitter areas of the transistors $T_3$ and $T_4$. The current in the current path $B_1$ is also defined and is $I_3 = K'I_2$, in which $K'$ is the ratio of the emitter areas of the transistors $T_1$ and $T_2$. As the currents $I_3$, $I_2$ and $I_1$ are defined irrespective of the voltage between the terminals $L_1$ and $L_2$, the current I which flows in the diodes $D_1$ and $D_2$ is also defined. The requirement for a minimum voltage between $L_1$ and $L_2$ is that $V > V_{D1} + V_{D2} + V_{CE1}$, where $V_{CE1}$ is the voltage between the emitter and the collector of the transistor $T_1$ in the bottomed or substantially bottomed state.

The principal elements of the device of FIG. 2 are again shown in the diagram of FIG. 3.

A first current dividing circuit is constituted by a transistor $T_7$ with two collectors, one of these collectors being connected to the base. Similarly, a second current dividing circuit is constituted by a transistor $T_6$ with two collectors, of which one collector is connected to the base. In series with the current path which includes the collector-emitter path of the transistor $T_7$ and the emitter-base diode of transistor $T_8$, a resistor $R_2$ is connected. The circuit to be powered is represented by the two diodes $D_3$ and $D_4$ which are included between the terminal G of the resistor $R_2$ and the conductor $L_4$. An ignition transistor $T_8$, whose base is not connected, is included between the conductor $L_3$ and the terminal G. The operation of the device shown in FIG. 3 is similar to that of the device described with reference to FIG. 2.

What is claimed is:

1. A device for supplying a regulated supply current to an integrated circuit to be powered, which integrated circuit comprises current injectors and at least two supply terminals for the application thereto of a supply current, the device comprising two current paths connected between two common supply terminals, a first current dividing circuit coupled to said two current paths and which defines a substantially fixed ratio between the currents in the two current paths, and a coupling circuit coupled to said two current paths and which provides current-dependent coupling between the two current paths so as to stabilize the currents in the two paths at a specific value, and wherein the integrated circuit to be powered, viewed between its two power supply terminals, is included in the device as at least one semiconductor junction coupled in shunt with the input circuit of said current dividing circuit so as to determine the current stabilizing point.

2. A device for supplying a regulated supply current to an integrated circuit to be powered, which integrated circuit comprises current injectors and at least two supply terminals for the application thereto of a supply current, the device comprising two current paths connected between two common supply terminals, a first current dividing circuit coupled to said two current paths and which defines a substantially fixed ratio between the currents in the two current paths, and a coupling circuit coupled to said two current paths and which provides current-dependent coupling between the two current paths so as to stabilize the currents in the two paths at a specific value, the coupling circuit comprising a second current dividing circuit which couples the two currents paths, each of said current dividing circuits having an input terminal and an output terminal, means connecting the input terminal of the second current dividing circuit to the output terminal of the first current dividing circuit via an impedance, and means connecting the input terminal of the first current dividing circuit to the output of the second current dividing circuit whereby the two current dividing circuits provide a coupling between the two current paths in a manner such that the open loop gain from the input terminal of the first current dividing circuit to the output terminal of the second current dividing circuit is greater than unity, and wherein the integrated circuit to be powered, viewed between its two power supply terminals, is included in the device as at least one semiconductor junction which also determines the stabilizing point and is connected to shunt said impedance and the input circuit of the second current dividing circuit so that when energised it causes a voltage drop which is greater than the voltage drop across the input circuit of the second current dividing circuit upon energisation.

3. A device as claimed in claim 2, wherein each of the two current dividing circuits comprises two transistors of the same conductivity type, the same structure, the same shape and the same materials, one of the said transistors having a direct connection between its collector and its base, the emitters of the two transistors of each current dividing circuit being interconnected as are their bases.

4. A device as claimed in claim 3, wherein the transistors of one of the current dividing circuits have a common base and a common emitter, and are thus reduced to a single transistor with two collectors.

5. A device as claimed in claim 2 wherein the circuit to be powered includes two diode stages.

6. A device as claimed in claim 2 wherein the circuit to be powered comprises a single diode stage, one forward-biased diode being connected in series with the circuit to be powered.

7. A device as claimed in claim 2 wherein each of the two current dividing circuits comprises two transistors of the same conductivity type, structure, shape and materials, means directly connecting the base and collector of a first transistor of each current dividing circuit, means connecting the emitters of the two transistors of the first current dividing circuit together and their bases together, means connecting the emitters of the two transistors of the second current dividing circuit together and their bases together, the transistors of the first current dividing circuit being of the pnp conductivity type and the transistors of the second current dividing circuit being of the npn conductivity type, the circuit which is in parallel with the circuit to be powered comprising the impedance and a semiconductor junction of a transistor of the second current dividing circuit.

8. A device as claimed in claim 7, wherein the transistors of the first current dividing circuit have a lateral structure and the transistors of the second current dividing circuit have a vertical structure.

9. A device as claimed in claim 2 wherein the device includes a means for introducing an ignition current into the feedback loop constituted by the two current dividing circuits and the impedance.

10. A device as claimed in claim 4 wherein the ignition means includes a transistor having an emitter connected to a common terminal, whose base is disconnected, and its collector connected in circuit to supply collector current into the feedback loop.

11. A device as claimed in claim 9, wherein the ignition means comprises a capacitance element included between a common terminal and a specific point of the feedback loop via a transistor for amplifying the discharge current.

12. A device as claimed in claim 9 wherein the ignition means comprises, a transistor having its emitter-collector circuit connected to supply a current to said feedback loop, and a capacitor coupled between a source of voltage and the base of the transistor.

13. A device as claimed in claim 2 wherein at least one of the current dividing circuits comprises a transistor having a base, an emitter and two collectors, and means directly connecting one collector to the base.

* * * * *